US008900414B2

(12) United States Patent
Käser

(10) Patent No.: US 8,900,414 B2
(45) Date of Patent: Dec. 2, 2014

(54) FIBER PRODUCTS

(75) Inventor: Adolf Käser, Bottmingen (CH)

(73) Assignee: Datalase, Ltd., Cheshire (GB)

( * ) Notice: Subject to any disclaimer, the term of this patent is extended or adjusted under 35 U.S.C. 154(b) by 712 days.

(21) Appl. No.: 12/682,792

(22) PCT Filed: Oct. 21, 2008

(86) PCT No.: PCT/EP2008/064166

§ 371 (c)(1),
(2), (4) Date: Aug. 11, 2010

(87) PCT Pub. No.: WO2009/059888

PCT Pub. Date: May 14, 2009

(65) Prior Publication Data

US 2010/0304166 A1 Dec. 2, 2010

(30) Foreign Application Priority Data

Nov. 7, 2007 (EP) ..... 07120159

(51) Int. Cl.

| | |
|---|---|
| ***D21H 23/04*** | (2006.01) |
| ***D21H 25/04*** | (2006.01) |
| ***D21H 17/09*** | (2006.01) |
| ***D21H 17/10*** | (2006.01) |
| ***D21H 17/28*** | (2006.01) |
| ***D21H 17/45*** | (2006.01) |
| ***D21H 17/56*** | (2006.01) |
| ***D21H 21/10*** | (2006.01) |
| ***B41M 5/26*** | (2006.01) |
| ***D21H 27/02*** | (2006.01) |
| *D21H 17/37* | (2006.01) |
| *D21H 17/65* | (2006.01) |

(52) U.S. Cl.

CPC ..... *B41M 5/26* (2013.01); *D21H 27/02* (2013.01); *D21H 17/09* (2013.01); *D21H 17/10* (2013.01); *D21H 17/375* (2013.01); *D21H 17/56* (2013.01); *D21H 17/65* (2013.01); *D21H 21/10* (2013.01)

USPC ..... 162/168.3; 162/158; 162/168.1; 162/175; 162/181.1; 162/164.1

(58) Field of Classification Search

USPC ..... 162/158, 164.1, 164.6, 159, 175, 181.1, 162/181.3, 185; 427/554

See application file for complete search history.

(56) References Cited

U.S. PATENT DOCUMENTS

| | | | | |
|---|---|---|---|---|
| 2,286,726 | A | | 6/1942 | Emerson |
| 3,161,770 | A | | 12/1964 | Huett et al. |
| 3,959,571 | A | | 5/1976 | Yahagi et al. |
| 4,157,982 | A | * | 6/1979 | Clemons et al. ..... 516/66 |
| 4,446,324 | A | | 5/1984 | Graser |
| 4,623,557 | A | | 11/1986 | Yamori et al. |
| 4,680,598 | A | | 7/1987 | Obitsu et al. |
| 4,820,683 | A | | 4/1989 | Vervacke et al. |
| 4,861,620 | A | | 8/1989 | Azuma et al. |
| 4,981,675 | A | | 1/1991 | Haase et al. |
| 5,028,643 | A | | 7/1991 | Jaffe |
| 5,075,195 | A | | 12/1991 | Bäbler et al. |
| 5,166,350 | A | | 11/1992 | Bedekovic et al. |
| 5,171,624 | A | | 12/1992 | Walter |
| 5,329,006 | A | | 7/1994 | Baumann et al. |
| 5,354,633 | A | | 10/1994 | Lewis et al. |
| 5,380,694 | A | | 1/1995 | Krebs |
| 5,413,629 | A | | 5/1995 | Yasui et al. |
| 5,446,011 | A | | 8/1995 | Hayakawa et al. |
| 5,470,502 | A | | 11/1995 | Hahn et al. |
| 5,718,754 | A | | 2/1998 | Macpherson et al. |
| 5,721,190 | A | | 2/1998 | Miyamoto et al. |
| 5,733,414 | A | | 3/1998 | Stockwell |
| 5,879,855 | A | | 3/1999 | Schädeli et al. |
| 5,888,283 | A | | 3/1999 | Mehta et al. |
| 5,897,938 | A | | 4/1999 | Shinmoto et al. |
| 6,022,905 | A | | 2/2000 | Harris et al. |
| 6,054,021 | A | | 4/2000 | Kurrle et al. |
| 6,174,586 | B1 | | 1/2001 | Peterson |
| 6,210,472 | B1 | | 4/2001 | Kwan et al. |
| 6,274,065 | B1 | | 8/2001 | Deno et al. |
| 6,290,765 | B1 | | 9/2001 | Jaycock et al. |
| 6,306,493 | B1 | | 10/2001 | Brownfield |
| 6,335,783 | B1 | | 1/2002 | Kruit |
| 6,372,394 | B1 | | 4/2002 | Zientek |
| 6,372,819 | B1 | | 4/2002 | Mizobuchi et al. |
| 6,475,695 | B2 | | 11/2002 | Kuroki et al. |

(Continued)

FOREIGN PATENT DOCUMENTS

| | | |
|---|---|---|
| CN | 1537059 | 10/2004 |
| DE | 2130845 | 1/1972 |

(Continued)

OTHER PUBLICATIONS

Knepper, "Synthetic chelating agents and compounds exhibiting complexing properties in the aquatic environment," Trends in Analytical Chemistry, vol. 22, No. 10, pp. 708-724, (2003).

International Search Report issued Feb. 12, 2009 in International Application No. PCT/EP2008/064166.

International Preliminary Report on Patentability issued May 11, 2010 in International Application No. PCT/EP2008/064166.

Anklam, E., "A review of the analytical methods to determine the geographical and botanical origin of honey," Food Chemistry vol. 63, No. 4, pp. 549-562, (1998).

Howbert, et al., "Novel Agents Effective against Solid Tumors: The Diarylsulfonylureas. Synthesis, Activities, and Analysis of Quantitative Structure-Activity Relationships," J. Med. Chem., vol. 33, Issue. 9, pp. 2393-2407, (1990).

(Continued)

*Primary Examiner* — Dennis Cordray

(74) *Attorney, Agent, or Firm* — Stoel Rives, LLP; Zhi Xiang (Alex) Oh

(57) ABSTRACT

Fiber products, comprising in their body at least 20% by weight of cellulose fibers, and adequate amounts of an acid and a cationic retention aid for the acid, can be marked by means of a laser beam.

11 Claims, No Drawings

(56) References Cited

U.S. PATENT DOCUMENTS

| | | | | |
|---|---|---|---|---|
| 6,596,386 | B1 * | 7/2003 | Reck et al. | 428/292.4 |
| 6,677,273 | B2 | 1/2004 | Torii et al. | |
| 6,706,785 | B1 | 3/2004 | Fu | |
| 6,906,735 | B2 | 6/2005 | Bhatt et al. | |
| 7,144,676 | B2 | 12/2006 | Barr et al. | |
| 7,597,961 | B2 | 10/2009 | Maruvada et al. | |
| 8,021,820 | B2 | 9/2011 | O'Donoghue et al. | |
| 8,101,544 | B2 | 1/2012 | O'Donoghue et al. | |
| 8,178,277 | B2 | 5/2012 | Campbell et al. | |
| 2001/0006757 | A1 | 7/2001 | Fukino et al. | |
| 2002/0155291 | A1 | 10/2002 | Daga et al. | |
| 2003/0104938 | A1 | 6/2003 | Torii et al. | |
| 2003/0228439 | A1 | 12/2003 | Kawakami | |
| 2004/0106163 | A1 | 6/2004 | Workman et al. | |
| 2004/0157947 | A1 | 8/2004 | Heneghan | |
| 2004/0242414 | A1 | 12/2004 | Morita et al. | |
| 2005/0119368 | A1 | 6/2005 | Hall-Goulle et al. | |
| 2005/0148467 | A1 | 7/2005 | Makitalo et al. | |
| 2005/0186511 | A1 | 8/2005 | Khan | |
| 2006/0040217 | A1 | 2/2006 | Stubbs | |
| 2006/0072437 | A1 | 4/2006 | Shiono et al. | |
| 2006/0094599 | A1 | 5/2006 | Kuboyama et al. | |
| 2006/0147842 | A1 | 7/2006 | Khan | |
| 2006/0154818 | A1 | 7/2006 | Destro et al. | |
| 2006/0155007 | A1 | 7/2006 | Huber | |
| 2007/0082139 | A1 * | 4/2007 | Dermeik et al. | 427/393.3 |
| 2007/0087292 | A1 | 4/2007 | Day et al. | |
| 2007/0098900 | A1 | 5/2007 | Abe et al. | |
| 2007/0218206 | A1 | 9/2007 | Reichert et al. | |
| 2008/0023164 | A1 * | 1/2008 | Fredlund et al. | 162/164.2 |
| 2008/0207444 | A1 | 8/2008 | O'Donoghue et al. | |
| 2009/0107645 | A1 * | 4/2009 | Legnerfalt et al. | 162/176 |
| 2009/0191420 | A1 | 7/2009 | O'Donoghue et al. | |
| 2009/0220749 | A1 | 9/2009 | O Donoghue et al. | |
| 2010/0104825 | A1 | 4/2010 | Campbell et al. | |
| 2010/0279079 | A1 | 11/2010 | Campbell et al. | |
| 2011/0065576 | A1 | 3/2011 | Campbell et al. | |
| 2011/0183126 | A1 * | 7/2011 | Walker et al. | 428/195.1 |
| 2011/0311786 | A1 | 12/2011 | Cunningham et al. | |
| 2012/0045624 | A1 | 2/2012 | Campbell et al. | |

FOREIGN PATENT DOCUMENTS

| | | |
|---|---|---|
| DE | 1670332 | 3/1972 |
| DE | 4407905 | 9/1995 |
| DE | 1 970 4478 | 8/1998 |
| EP | 0165608 | 12/1985 |
| EP | 0187329 | 7/1986 |
| EP | 0319283 | 6/1989 |
| EP | 0546577 | 6/1993 |
| EP | 0600441 | 6/1994 |
| EP | 0637514 | 2/1995 |
| EP | 0659583 | 6/1995 |
| EP | 0704437 | 4/1996 |
| EP | 0754564 | 1/1997 |
| EP | 0792756 | 9/1997 |
| EP | 0941989 | 9/1999 |
| EP | 0949251 | 10/1999 |
| EP | 1208995 | 5/2002 |
| EP | 1295730 | 3/2003 |
| EP | 1367437 | 12/2003 |
| EP | 1645430 | 4/2006 |
| GB | 1347647 | 2/1974 |
| GB | 1389716 | 4/1975 |
| GB | 2002801 | 2/1979 |
| GB | 1548059 | 7/1979 |
| GB | 2154597 | 9/1985 |
| JP | 61-022988 | 1/1986 |
| JP | 63-172689 | 7/1988 |
| JP | 1232093 | 9/1989 |
| JP | 02-044562 | 2/1990 |
| JP | 02293181 | 12/1990 |
| JP | 7017134 | 1/1995 |
| JP | 08267915 | 10/1996 |
| JP | 9-156228 | 6/1997 |
| JP | 09-254552 | 9/1997 |
| JP | 10282657 | 10/1998 |
| JP | 11-115317 | 4/1999 |
| JP | 2000/200830 | 7/2000 |
| JP | 2000/238237 | 9/2000 |
| JP | 2003-276334 | 9/2003 |
| JP | 2004/045549 | 2/2004 |
| JP | 2004/160806 | 6/2004 |
| JP | 2005/022366 | 1/2005 |
| JP | 2005/305872 | 11/2005 |
| JP | 2006/021500 | 1/2006 |
| JP | 2006/291082 | 10/2006 |
| JP | 2007/125578 | 5/2007 |
| WO | WO 97/10307 | 3/1997 |
| WO | WO 00/35679 | 6/2000 |
| WO | WO 02/068205 | 9/2002 |
| WO | WO 02/074548 | 9/2002 |
| WO | WO 02/100914 | 12/2002 |
| WO | WO 2004/043704 | 5/2004 |
| WO | WO 2005/012442 | 2/2005 |
| WO | WO 2005/068207 | 7/2005 |
| WO | WO 2005/108103 | 11/2005 |
| WO | WO 2006/041401 A1 * | 4/2006 |
| WO | WO 2006/052843 | 5/2006 |
| WO | WO 2006/061343 | 6/2006 |
| WO | WO 2006/067073 | 6/2006 |
| WO | WO 2006/069653 | 7/2006 |
| WO | WO 2006/129078 | 12/2006 |
| WO | WO 2006/129086 | 12/2006 |
| WO | WO 2007/012578 | 2/2007 |
| WO | WO 2007/057367 | 5/2007 |
| WO | WO 2007/088104 | 8/2007 |
| WO | WO 2008/055796 | 5/2008 |
| WO | WO 2010/049281 | 5/2010 |

OTHER PUBLICATIONS

Kurzer, F., "Sulfonylureas and Sulfonylthioureas," Chem. Rev., vol. 50, Issue. 1, pp. 1-46, (1952).

Ulrich, H., "The Chemistry of Sulfonylisocyanates," Chem. Rev., vol. 65, Issue. 365, pp. 369-376, (1965).

Knepper, T.P., "Synthetic chelating agents and compounds exhibiting complexing properties in the aquatic environment," Trends in Analytical Chemistry, vol. 22, No. 10, pp. 708-724, (2003).

Ninagawa et al., "Formaldehyde Polymers, 26[a]) : Syntheses and Condensations of Substituted Triphenoxy and Triphenyl Derivatives of 1,3,5-Triazine," Makromol. Chem., vol. 180, pp. 2123-2131, (1979).

"Honey," Wikipedia, http://en.wikipedia.org/wiki/Honey, 16 pgs., (retrieved Sep. 28, 2010).

Preliminary Amendment filed Jun. 20, 2007 in U.S. Appl. No. 11/793,499.

Office Action issued May 12, 2011 in U.S. Appl. No. 11/793,499.

Response to Office Action filed Aug. 8, 2011 in U.S. Appl. No. 11/793,499.

Notice of Allowance issued Sep. 26, 2011 in U.S. Appl. No. 11/793,499.

International Search Report issued May 11, 2006 in International Application No. PCT/EP2005/056763.

Written Opinion of the International Search Authority issued Jun. 26, 2007 in International Application No. PCT/EP2005/056763.

International Preliminary Report on Patentability issued Jun. 26, 2007 in International Application No. PCT/EP2005/056763.

EPO Communication issued Oct. 11, 2013 in EP Patent Application No. EP 2005819361.

Response to EPO Communication filed Apr. 17, 2014 in EP Application No. 2005819361.

Preliminary Amendment filed Jul. 15, 2008 in U.S. Appl. No. 12/087,806.

Office Action issued Dec. 8, 2010 in U.S. Appl. No. 12/087,806.

Response to Office Action filed Apr. 6, 2011 in U.S. Appl. No. 12/087,806.

Notice of Allowance issued Jun. 15, 2011 in U.S. Appl. No. 12/087,806.

(56) References Cited

OTHER PUBLICATIONS

International Search Report issued May 7, 2007 in International Application No. PCT/EP2007/050421.
Written Opinion of the International Search Authority issued Jul. 31, 2008 in International Application No. PCT/EP2007/050421.
International Preliminary Report on Patentability issued Aug. 5, 2008 in International Application No. PCT/EP2007/050421.
EPO Communication issued Sep. 3, 2010 in European Patent Application No. EP 2007712043.
Response to EPO Communication filed Dec. 20, 2010 in European Patent Application No. EP 2007712043.
EPO Communication issued Dec. 1, 2011 in European Patent Application No. EP 2007712043.
Response to EPO Communication filed Jul. 18, 2012 in European Patent Application No. EP 2007712043.
Preliminary Amendment filed Jun. 16, 2009 in U.S. Appl. No. 12/519,423.
Office Action issued Jun. 24, 2011 in U.S. Appl. No. 12/519,423.
Response to Office Action filed Oct. 20, 2011 in U.S. Appl. No. 12/519,423.
Office Action issued Nov. 21, 2011 in U.S. Appl. No. 12/519,423.
Response to Office Action filed Dec. 20, 2011 in U.S. Appl. No. 12/519,423.
Notice of Allowance issued Jan. 17, 2012 in U.S. Appl. No. 12/519,423.
Response to Office Action filed Apr. 6, 2012 in U.S. Appl. No. 12/519,423.
Office Action issued Apr. 9, 2012 in U.S. Appl. No. 12/519,423.
International Search Report issued Feb. 27, 2008 in International Application No. PCT/EP2007/064408.
International Preliminary Report on Patentability issued Jul. 14, 2009 in International Application No. PCT/EP2007/064408.
Written Opinion issued Jul. 9, 2009 in International Application No. PCT/EP2007/064408.
EPO Communication issued Nov. 17, 2009 in EP Patent Application No. 2007858026.
Response to EPO Communication filed Mar. 3, 2010 in EP Patent Application No. 2007858026.
EPO Communication issued Mar. 24, 2010 in EP Patent Application No. 2007858026.
Response to EPO Communication filed Sep. 28, 2010 in EP Patent Application No. 2007858026.
EPO Communication issued Aug. 18, 2011 in EP Patent Application No. 2007858026.
Response to EPO Communication filed Sep. 8, 2011 in EP Patent Application No. 2007858026.
EPO Communication issued Feb. 14, 2012 in EP Patent Application No. 2007858026.
Response to EPO Communication filed Mar. 1, 2012 in EP Patent Application No. 2007858026.
EPO Communication issued Apr. 3, 2012 in EP Patent Application No. 2007858026.
Response to EPO Communication filed May 4, 2012 in EP Patent Application No. 2007858026.
EPO Communication issued Oct. 10, 2013 in EP Patent Application No. 2007858026.
Response to EPO Communication filed Apr. 15, 2014 in EP Patent Application No. 2007858026.
Preliminary Amendment filed Aug. 24, 2009 in U.S. Appl. No. 12/528,352.
Office Action issued Dec. 14, 2011 in U.S. Appl. No. 12/528,352.
International Search Report issued May 20, 2008 in International Application No. PCT/EP2008/052332.
International Preliminary Report on Patentability issued Sep. 8, 2009 in International Application No. PCT/EP2008/052332.
Written Opinion issued Sep. 8, 2009 in International Application No. PCT/EP2008/052332.
EPO Communication issued Dec. 23, 2009 in EP Application No. 2008717151.
Response to EPO Communication filed Jun. 30, 2010 in EP Application No. 2008717151.
EPO Communication issued Jul. 27, 2010 in EP Application No. 2008717151.
Response to EPO Communication filed Nov. 26, 2010 in EP Application No. 2008717151.
EPO Communication issued Dec. 23, 2010 in EP Application No. 2008717151.
Response to EPO Communication filed Apr. 8, 2011 in EP Application No. 2008717151.
EPO Communication issued May 10, 2011 in EP Application No. 2008717151.
Preliminary Amendment filed Sep. 3, 2009 in U.S. Appl. No. 12/529,718.
Office Action issued May 10, 2013 in U.S. Appl. No. 12/529,718.
Response to Office Action filed Aug. 29, 2013 in U.S. Appl. No. 12/529,718.
Office Action issued Dec. 23, 2013 in U.S. Appl. No. 12/529,718.
Response to Office Action filed May 23, 2014 in U.S. Appl. No. 12/529,718.
International Search Report issued Aug. 5, 2008 in International Application No. PCT/EP2008/052637.
International Preliminary Report on Patentability issued Sep. 15, 2009 in International Application No. PCT/EP2008/052637.
Written Opinion issued Sep. 15, 2009 in International Application No. PCT/EP2008/052637.
EPO Communication issued Dec. 17, 2009 in EP Application No. 2008717393.
Response to EPO Communication filed Jun. 16, 2010 in EP Application No. 2008717393.
Preliminary Amendment filed Feb. 1, 2010 in U.S. Appl. No. 12/671,547.
Office Action issued Aug. 1, 2012 in U.S. Appl. No. 12/671,547.
Response to Office Action filed Oct. 25, 2012 in U.S. Appl. No. 12/671,547.
Office Action issued Jan. 31, 2013 in U.S. Appl. No. 12/671,547.
Response to Office Action filed Jul. 1, 2013 in U.S. Appl. No. 12/671,547.
Office Action issued Jul. 17, 2013 in U.S. Appl. No. 12/671,547.
Response to Office Action filed Jul. 30, 2013 in U.S. Appl. No. 12/671,547.
Office Action issued May 15, 2014 in U.S. Appl. No. 12/671,547.
International Search Report issued Oct. 21, 2008 in International Application No. PCT/EP2008/060550.
International Preliminary Report on Patentability issued Feb. 24, 2010 in International Application No. PCT/EP2008/060550.
Written Opinion issued Feb. 22, 2010 in International Application No. PCT/EP2008/060550.
EPO Communication issued Jul. 15, 2010 in EP Application No. 2008787124.
Response to EPO Communication filed Nov. 17, 2010 in EP Application No. 2008787124.
Written Opinion issued May 7, 2010 in International Application No. PCT/EP2008/064166.
EPO Communication issued Apr. 5, 2013 in EP Application No. 2008848155.
Response to EPO Communication issued May 20, 2014 in EP Application No. 2008848155.
Preliminary Amendment filed Apr. 11, 2011 in U.S. Appl. No. 13/123,607.
Office Action issued Jun. 17, 2013 in U.S. Appl. No. 13/123,607.
Response to Office Action filed Sep. 17, 2013 in U.S. Appl. No. 13/123,607.
Office Action issued Oct. 1, 2013 in U.S. Appl. No. 13/123,607.
Response to Office Action filed Mar. 31, 2014 in U.S. Appl. No. 13/123,607.
International Search Report issued Dec. 3, 2009 in International Application No. PCT/EP2009/063520.
International Preliminary Report on Patentability issued May 3, 2011 in International Application No. PCT/EP2009/063520.
Written Opinion issued Apr. 27, 2011 in International Application No. PCT/EP2009/063520.

(56) References Cited

OTHER PUBLICATIONS

EPO Communication issued Jul. 4, 2011 in European Application No. 09737404.
Response to the EPO Communication filed Jul. 19, 2011 in European Application No. 09737404.
Office Action issued Aug. 9, 2010 in U.S. Appl. No. 11/978,764.
Response to Office Action filed Nov. 9, 2010 in U.S. Appl. No. 11/978,764.
Office Action issued Dec. 16, 2010 in U.S. Appl. No. 11/978,764.
Office Action issued Feb. 1, 2011 in U.S. Appl. No. 11/978,764.
Response to Office Action filed May 2, 2011 in U.S. Appl. No. 11/978,764.
Office Action issued May 12, 2011 in U.S. Appl. No. 11/978,764.
Notice of Allowance issued Jun. 24, 2014 in U.S. Appl. No. 12/529,718.
Notice of Allowance issued Apr. 9, 2014 in U.S. Appl. No. 13/123,607.
Notice of Allowance issued Jul. 7, 2014 in U.S. Appl. No. 13/123,607.

* cited by examiner

FIBER PRODUCTS

This application is a 371 of PCT/EP2008/064166, filed Oct. 21, 2008 and claims priority to European Application No. 07120159.4, filed Nov. 7, 2007.

The present invention relates to a fiber product comprising in its body at least 20% by weight of cellulose fibers, and adequate amounts of an acid and a cationic retention aid for the acid; to a process for its manufacture; to a process for preparing a marked fiber product by means of a laser beam; to a marked fiber product obtained by said process; and to the use of said fiber product for exposing those parts of the fiber product, where a marking is intended, to energy by means of a laser beam.

Paper or paperboard packaging usually needs to be marked with information such as logos, bar codes, expiry dates or batch numbers. Traditionally, the marking of paper or paperboard packaging is achieved by various printing techniques for example ink-jet or thermal transfer printing, or by labelling. However, these traditional marking methods are more and more replaced by laser marking as laser marking has several advantages. For example, laser marking allows contact free and quick marking, even of packaging with an uneven surface. In addition, laser markings can be obtained that are so small that the markings are invisible or nearly invisible to the human eye.

One way to achieve laser marking of paper or paperboard packaging is by coating the paper or paper board packaging with a composition, which upon treatment with laser irradiation forms a visible marking on the parts of the coating that were exposed to the laser irradiation. For example, WO 2007/031454 describes substrates coated with a laser markable coating composition which comprises a salt of an amine and an acid, for example ammonium sulphate, a char forming compound, for example sucrose, and an acrylic binder.

Another way to achieve laser marking is by preparing paper or paperboard packaging comprising a material that forms a visible mark when exposed to laser irradiation, by adding this material to the cellulosic stock in the wet end section of the paper or paperboard production. For example, EP 0 894 896 describes laser-markable paper and paperboard comprising microparticulate aromatic polymers, for example polyphenylene sulphide, which is prepared by adding the microparticulate aromatic polymers in the wet end section in the preparation of the paper and paperboard. DE 197 04 478 describes laser-markable paper and paperboard comprising microparticulate inorganic material in the form of plates.

WO 2005/054576 A1 describes that fiber products can be made flame-retardant by applying a branched polyethyleneimine which contains primary, secondary or tertiary amino groups and which has a weight average molecular weight in the range from 5000 to 1500000, and in which the numerical ratio of secondary amino groups to primary amino groups is in the range from 1.00:1 to 2.50:1 and the numerical ratio of secondary amino groups to tertiary amino groups is in the range from 1.20:1 to 2.00:1, and a phosphonic acid carrying the functional group —$PO(OH)_2$ directly bonded to a carbon atom of the acid.

Surprisingly, it has now been found that fiber (American English: fiber; British English: fibre) products comprising within the body of the fiber product adequate amounts of an acid and a retention aid (fixing agent) for the acid can be marked by laser irradiation.

Hence, the present invention relates to a process for preparing a marked fiber product comprising at least 20% by weight of cellulose fibers, based on the weight of the anhydrous fiber product, comprising the steps of i) incorporating adequate amounts of
   a) at least one acid,
   b) at least one cationic retention aid for the acid, and
   c) if desired, further the body of the fiber product additives into the body of the fiber product, and
ii) exposing those parts of the resulting fiber product, where a marking is intended, to energy by means of a laser beam, and to a marked fiber product obtainable by this process.

The invention relates also to the use of a fiber product comprising at least 20% by weight of cellulose fibers, based on the weight of the anhydrous fiber product, comprising in its body, i.e. not (only) in a potential coating on the fiber product, adequate amounts of at least one acid, at least one cationic retention aid for the acid, and if desired, further additives, for exposing those parts of the fiber product, where a marking is intended, to energy by means of a laser beam.

The invention relates also to a fiber product comprising at least 20% by weight of cellulose fibers, based on the weight of the anhydrous fiber product, comprising in its body an adequate amount of at least one acid, between 1 and 2.8%, preferably between 1 and 2.0%, by weight based on 100% anhydrous fiber substrate of a cationic retention aid for the acid, and if desired, further additives.

The invention relates also to a fiber product comprising at least 20% by weight of cellulose fibers, based on the weight of the anhydrous fiber product, comprising in its body adequate amounts of at least one acid, a cationic retention aid for the acid, and if desired, further additives, with the proviso that i) said retention aid is different from a branched polyethyleneimine which contains primary, secondary or tertiary amino groups and which has a weight average molecular weight in the range from 5000 to 1500000, and in which the numerical ratio of secondary amino groups to primary amino groups is in the range from 1.00:1 to 2.50:1 and the numerical ratio of secondary amino groups to tertiary amino groups is in the range from 1.20:1 to 2.00:1, or
ii) said acid does not have or carry the functional group —$PO(OH)_2$ directly bonded to a carbon atom of the acid.

Preferably, the invention relates to the fiber products mentioned above, wherein the fiber product comprises in its body at least 20% by weight of cellulose fibers, based on the weight of the anhydrous fiber product, a cationic retention aid for the acid (especially between 1 and 2.8%, preferably between 1 and 2.0%, by weight, based on 100% anhydrous fiber substrate, of a cationic retention aid), and a total between 1 and 6.0% by weight, based on 100% fiber substrate, of at least one acid; and if desired, further additives.

In comparison to control fiber products not containing an acid, the marked fiber products of the present invention exhibit considerably stronger marks.

The fiber product is preferably paper or board, like paperboard or cardboard. In the context of the invention described here, a fiber product comprising at least 20% by weight of cellulose fibers is understood as meaning a product which contains from 20 to 100% by weight of cellulose fibers. This range for the content of the cellulose fibers is based on the anhydrous fiber product, i.e. based on the fiber product without water and without the acid, retention aid and further additives. The above definition is usual in the paper industry, i.e. the fibre substrate is always taken as 100% and then loaded with effect chemicals (additives). Suitable acids need to have one or preferably more of the following qualities, i.e.

a) a natural affinity to paper,
b) a certain lipophilicity,
c) a good retention in the paper making stock, e.g. by interaction with the added retention aid.

Suitable acids are e.g. polymers or oligomers with multiple acidic moieties or monomeric acids carrying at least two acidic moieties. Said acidic moieties are directly bound to a carbon atom of the acid and are e.g. selected from —PO$(OH)_2$, —O—PO$(OH)_2$, —PHO(OH), —$SO_2OH$, —$OSO_2OH$, —SOOH, —COOH (preferably selected from —O—PO$(OH)_2$, —PHO(OH), —$SO_2OH$, —$OSO_2OH$, —SOOH and —COOH), and boric acid groups and derivatives thereof, wherein the proton in the OH group of the before-mentioned acidic moieties may be at least partially, e.g. to about 50%, replaced by ammonium or a protonated amine.

Suitable acids are natural or synthetic acids, like a) polyphosphoric acids, b) homo- or copolymers based on ethenic acid monomers, such as vinyl phosphonic acid, vinylsulfuric acid ($H_2C{=}CH{-}OSO_3H$), vinyl sulfonic acid ($H_2C{=}CH{-}SO_3H$), methylallyl sulfonic acid (MAS),2-acrylamido-2-methylpropanesulfonic acid (AMPS), styrenesulfonic acid, maleic acid, maleic acid anhydride, fumaric acid, or acrylic acid, c) copolymers based on neutral (ethenic) monomers, such as ethylene, butadiene, styrene, (meth)acrylamides, (meth) acrylates or maleic acid imide derivatives, or derivatives thereof, co-polymerised with the above-mentioned acid monomers, e.g. anionic PAMs, i.e. acrylamides co-polymerised with acrylic acid or with anionic acrylamide monomers, like 2-acrylamido-2-methyl-1-propanesulfonic acid, e.g. in the form of its sodium salt of the formula $CH_2{=}CH{-}CONH{-}CH_2{-}C(CH_3)_2{-}SO_3Na$, or d) sulfomethylated lignosulfonic acids, or sulfonated formaldehyde condensates.

Also suitable are monomeric acids carrying at least two of the above-mentioned acidic moieties, like phytic acid, or acids from the group of commercially available sequestering agents (which are described in Trends in Analytical Chemistry 22 (10), 2003, pp 708-722, and commercially available e.g. under the trade names Masquol or Briquest) including e.g. diethylenetriamine penta(methylenephosphonic acid) (DTPMP; also named diethylenetriaminepentakis [methylenephosphonic acid]), hexamethylenediamine tetra(methylene-phosphonic acid) (HDTMP or HDTP), nitrilotris(methylene phosphonic acid), 1-hydroxyethyl(id)ene-1,1-diphosphonic acid (HEDP or HEDPA), amino-tri(methylene) phosphonic acid (ATMP), ethylene diamine tetra-(methylene) phosphonic acid (EDTP), 2-phosphono-1,2,4-butanetricarboxylic acid (PBTC), and monomeric acids of lipophilic character and with affinity to paper, e.g. 2-(4-aminophenyl)-6-methylbenzothiazole-7-sulfonic acid (sold under the trivial name dehydroparathiotoluidine sulfonic acid), abietic acid, and certain triazene derivatives, e.g. 1,3,5-triazene derivatives substituted e.g. by aliphatic, aromatic or aromatic-aliphatic amino groups, e.g. alkylamino groups, carrying at least one of the above-mentioned acidic moieties.

Preferred acids are e.g. polyphosphoric acid, phytic acid, diethylenetriamine penta(methylenephosphonic acid), hexamethylenediamine tetra(methylene-phosphonic acid), nitrilotris(methylene phosphonic acid), 1-hydroxyethyl(id)ene-1,1-diphosphonic acid, amino-tri(methylene) phosphonic acid, ethylene diamine tetra-(methylene) phosphonic acid, 2-phosphono-1,2,4-butanetricarboxylic acid, 2-(4-aminophenyl)-6-methylbenzothiazole-7-sulfonic acid (dehydroparathiotoluidine sulfonic acid), and abietic acid, wherein the proton in the OH group of the before-mentioned acids may be at least partially replaced by ammonium or a protonated amine.

Particularly preferred are polyphosphoric acid, phytic acid, 2-(4-aminophenyl)-6-methylbenzothiazole-7-sulfonic acid (dehydroparathiotoluidine sulfonic acid), and abietic acid, wherein the proton in the OH group of the before-mentioned acids may be at least partially replaced by ammonium or a protonated amine.

Most preferred are polyphosphoric acid and phytic acid, wherein the proton in the OH group of the before-mentioned acids may be at least partially replaced by ammonium or a protonated amine.

Also suitable are inorganic acids, like sulfuric, sulfurous, phosphoric, and phosphorous acid; polymolybdic acids, polytungstic acids and their precursors, phosphomolybdic acid, phosphotungstic acid, and boric acid derivatives.

An adequate amount of the acid is an amount sufficient to enable laser marking of the fiber product. The acid is usually added in an amount of about 1 to 10%, preferably 1 to 6%, especially 2 to 6%, by weight based on 100% by weight of anhydrous fiber substrate. Before addition to the fiber substrate the acid may be partially pre-neutralized with a suitable base, like ethanolamine. For example, up to about 50% of the acid may thus be pre-neutralized. Hence, an adequate amount of the acid means especially 1 to 10%, preferably 1 to 6%, particularly 2 to 6%, by weight based on 100% by weight of anhydrous fiber substrate.

The cationic retention aid for the acid serves the purpose to retain the above-mentioned acid(s) with the cellulosic fibers.

Suitable cationic retention aids (cationic fixing agents) are e.g. natural or synthetic polymers with multiple cationic moieties, in particular natural and synthetic cationic polymers used in the paper making industry comprising a diversity of mol weights and charge densities as e.g. described in Handbook of Paper & Board, E. Holik, Wiley-VCH Verlag Weinheim, 2006, chapter 3: chemical additives: dry & wet strength agents, fixing agents, retention & drainage agents etc.

The above cationic retention aids comprise polymers having protonable functional groups or cationic groups and having a natural affinity for cellulosic fibers, like polyamines and polyimines, e.g. polyethylenimines (PEIs), polyvinylamines (PVams), polyallylamines (in particular poly(diallyldimethylammonium chlorides) [p-DADMACs]), epichlorohydrin based polyamines, dicyanodiamide based polyamines, cationic polyacrylamide based copolymers and terpolymers (so called cationic PAMs), cationic starches, and natural polymers with cationic character. Preferably, said cationic groups are non-quaternized amino functionalities.

Suitable polyethylenimines (PEIs) are e.g. branched polyethyleneimines containing primary, secondary and tertiary amino groups, e.g. high molecular weight polyethyleneimines like Lupasol® P, Lupasol® WF, or Lupasol® G500 available from BASF.

Suitable polyvinylamines (PVams) are e.g. unbranched polyethyleneamines derived from N-vinyl-formamide still carrying some residual non hydrolyzed formyl groups, like Luredur® VD, or Luredur® VI available from BASF.

Suitable polyallylamines (in particular poly(diallyldimethylammonium chlorides) are e.g. Alcofix® 110, Alcofix® 111, Alcofix® 169, Alcofix® 161 (the latter is a copolymerisate with acrylamide) available from Ciba Specialty Chemicals.

Suitable epichlorohydrin based polyamines are e.g. copolymers derived from epichlorohydrin and dialkylamines such as dimethylamine, like Alcofix® 135, Alcofix® 159, Alcofix® 160, Tinofix® AP available from Ciba Specialty Chemicals. Structuring can be induced by replacing small amounts of the dialkylamine by di- or tri-amines such as ethylene diamine or diethylene triamine.

Suitable dicyanodiamide based polyamines are e.g. copolymers derived from dicyanodiamide, formaldehyde and ammoniumchloride, LikeTinofix® WSP available from Ciba Specialty Chemicals, or from dicyanodiamide and alkylenetriamines e.g. diethylenetriamine, like Tinofix® ECO—N available from Ciba Specialty Chemicals.

Suitable cationic polyacrylamide based copolymers (cationic PAMs) are e.g. copolymers derived from acrylamide and a cationic monomer such as alkyl halide adducts of N,N-dialkylaminoalkyl(meth)acrylates, like N,N-dimethylaminoethylacrylate methyl chloride, or of dialkylamino-alkyl (meth)acrylamides, like dimethylaminopropylacrylamide, or of alkyldiallylamines, like methyldiallylamine.

Suitable cationic starches are e.g. derived from starch by reaction with glycidyl-trimethylammonium chloride (also called 2,3-epoxypropyl trimethyl ammonium chloride, cf. U.S. Pat. No. 6,290,765), like Raifix 01035, Raifix 25015, and Raifix 25035 available from Ciba Specialty Chemicals.

Suitable natural polymers with cationic character are e.g. certain aminocellulose derivatives, like chitosan (which is a polyaminosaccharide derived from chitin).

Preferred cationic retention aids are polyamines such as polyethylenimines (PEIs).

An adequate amount of the cationic retention aid for the acid is an amount sufficient to retain the acid within the body of the fiber product. The cationic retention aid for the acid is e.g. used or present in an amount of about 0.3 to 7% by weight, preferably 1-2.8%, most preferably 1-2%, by weight based on 100% fiber substrate. Hence, an adequate amount of the cationic retention aid for the acid means especially an amount of about 0.3 to 7% by weight, preferably 1-2.8%, most preferably 1-2%, by weight based on 100% fiber substrate.

Considering the relative amounts by weight of the acid versus the cationic retention aid for the acid, the acid is usually employed in an amount from about one-fold to about six-fold the amount by weight of the cationic retention aid for the acid, keeping in mind that the acid may be partially neutralized.

Preferred are fiber products wherein the retention aids for the acid are selected from polyvinylamines, polyallylamines, epichlorohydrin based polyamines, dicyanodiamide based polyamines, cationic polyacrylamide based copolymers and terpolymers, cationic starches, and natural polymers with cationic character.

If desired, the fiber product may further comprise additives. The additives that may be included in the fiber product of the present invention can be e.g. any component suitable for improving the performance of the fiber product, e.g. as described in Handbook of Paper & Board, E. Holik, Wiley-VCH Verlag Weinheim, 2006. Suitable additives are e.g. cationic coagulants, dry strength agents, retention aids (e.g. anionic inorganic microparticles) for the other additives, sizing agents; pH adjusting agents, such as inorganic or organic acids or bases; charge neutralizing agents, fillers, carbonizing agents, energy (e.g. heat) transfer agents, optical brighteners, dyes, dye fixatives, pigments, cross-linking agents, sequesterant agents, antiblocking materials, lubricants, flame retarding additives, stabilizers, antioxidants, rheology modifiers, wetting agents, biocides, smoke suppressants, and taggants.

It is possible that the same substance fulfils more than one function as an additive. For example, some substances can be both coagulants and retention aids. Other substances can be both fillers and pH adjusting agents, etc.

Said additives such as cationic coagulants, dry strength agents, retention aids, sizing agents, optical brighteners, fillers, and dye fixatives can be added to the stock in the wet end section. The order of addition and the specific addition points depend on the specific application, and are common papermaking practice.

Cationic coagulants are water-soluble low molecular weight compounds of relatively high cationic charge. The cationic coagulants can be inorganic compounds, like aluminium based fixing agents, such as aluminum sulfate, aluminium potassium sulfate (alum) or polyaluminium chloride (PAC); or an organic polymer such as polydiallyldimethylammoniumchloride, polyamidoamine/epichlorhydrin condensates or polyethyleneimine. The cationic coagulants are also usually added to the thick stock and serve to fix pitch and/or stickies.

Cationic coagulants, which are organic polymers, can also be added in order to neutralize the charge of the stock, which may be required, when, for example, an anionic retention aid of relatively high molecular weight is added later to the thin stock. In this case, the cationic coagulant is usually added very close to the dilution point to make thick stock into thin stock.

Examples of dry strength agents are water-soluble anionic copolymers of acrylamide of relatively low molecular weight (usually below one million g/mol) and polysaccharides of relatively high molecular weight. Examples of anionic copolymers of acrylamide are copolymers derived from acrylamide and an anionic monomer such as acrylic acid. The anionic copolymers of acrylamide are usually added to the thin stock. Examples of polysaccharides are carboxymethyl cellulose, guar gum derivatives and starch. Cationic starch, carboxymethyl cellulose and guar gum derivatives are usually added to the thick stock, whereas uncooked native starch can be sprayed on the forming web.

Preferably, retention aids are added in the wet end section in order to improve the retention of the acids, fines, fillers and fibers on the web. Examples of cationic retention aids for the acids in accordance with the present invention have been given above. Examples of retention aids for the (other) additives are water soluble polymers, anionic inorganic microparticles, polymeric organic microparticles and combinations thereof (retention systems). The retention aids are usually added to the thin stock, after the fan pump.

The water-soluble polymers used as retention aids can be non-ionic, cationic or anionic. Examples of non-ionic polymers are polyethylene oxide and polyacrylamide. Examples of anionic polymers are copolymers derived from acrylamide and an anionic monomer such as acrylic acid or 2-acrylamido-2 methyl-1-propane sulfonic acid. Preferably, the anionic polymers used as retention aids are of relatively high molecular weight (usually above one million g/mol).

Examples of anionic inorganic microparticles are colloidal silica and swelling clays such as bentonite. Examples of polymeric organic microparticles are described above.

Two or more retention aids can be combined to form a retention system. Examples of retention systems are combinations of anionic water-soluble polymers and anionic inorganic microparticles and combinations of cationic water-soluble polymers, anionic water-soluble polymers and anionic inorganic microparticles. When anionic water-soluble polymers are added in combination with an anionic inorganic microparticle, the two components can be added simultaneously, or the anionic inorganic microparticle is added first, followed by the addition of the polymer. When the retention system also comprises a cationic water-soluble polymer, this cationic polymer is usually added before adding the anionic water-soluble polymer and the anionic inorganic microparticle.

Further examples of retention systems are combinations of cationic water-soluble polymers and polymeric organic microparticles and combinations of cationic water-soluble polymers, anionic water-soluble polymers and polymeric organic microparticles.

Preferably, the retention aid is a cationic water-soluble polymer or a retention system comprising a cationic water-soluble polymer.

Examples of sizing agents are natural sizing agents, such as rosin, and synthetic sizing agents, such as alkenyl succinic anhydride (ASA) and alkyl ketene dimer (AKD).

pH adjusting agents are e.g. inorganic or organic acids or bases.

Charge neutralizing agents are e.g. anionic charge neutralizing agents, like nanosilicas and bentonites. Charge neutralizing agents are advantageously used in combination with cationic PAMs, i.e. when the acids present in the fiber product are polyacrylamides co-polymerised with maleic acid or with anionic acrylamide monomers, like 2-acrylamido-2-methyl-1-propanesulfonic acid, e.g. in the form of its sodium salt of the formula $CH_2{=}CH{-}CONH{-}CH_2{-}C(CH_3)_2{-}SO_3Na$.

Examples of fillers are mineral silicates such as talc, mica and clay such as kaolin, calcium carbonate such as ground calcium carbonate (GCC) and precipitated calcium carbonate (PCC), and titanium dioxide. The filler is usually added into the thick stock.

Carbonizing agents are char forming compounds. A char forming compound is a compound which forms char upon energy treatment. Generally, a char forming compound is of high carbon and oxygen content. Preferred carbonizing agents for the present invention have adequate affinity for cellulosic fibres.

Examples of suitable char forming compounds are carbohydrates such as polysaccharides, and derivatives thereof. Examples of suitable polysaccharides are starch, gum arabic, dextrin and cyclodextrin.

Energy transfer agents, e.g. heat transfer agents, can absorb the incident energy and transfer this energy to the system thermally or otherwise, such as UV absorber or especially IR absorber.

An example of a UV absorber is 2-hydroxy-4-methoxybenzophenone.

IR absorbers can be organic or inorganic. Examples of organic IR absorbers are alkylated triphenyl phosphorothionates, for example as sold under the trade name Ciba® Irgalube® 211 or Carbon Black, for example as sold under the trade names Ciba® Microsol® Black 2B or Ciba® Microsol® Black C-E2.

Examples of inorganic IR absorbers are oxides, hydroxides, sulfides, sulfates and phosphates of metals such as copper, bismuth, iron, nickel, tin, zinc, manganese, zirconium and antimony, including antimony(V) oxide doped mica and tin(IV) oxide doped mica.

Examples of optical brighteners are stilbene derivatives such as sold, for example, under the tradename Ciba® Tinopal® CBS-X.

Pigments can be added as inorganic IR absorbers, for enhanced contrast between unimaged and imaged areas or as a security feature.

Examples of pigments which function as inorganic IR absorbers are kaolin, calcined kaolin, mica, aluminum oxide, aluminum hydroxide, aluminum silicates, talc, amorphous silica and colloidal silicon dioxide.

Examples of pigments which can be added for enhanced contrast between unimaged and imaged area are titan dioxide, calcium carbonate, barium sulfate, polystyrene resin, urea-formaldehyde resin, hollow plastic pigment.

Examples of pigments which can be added as a security feature are fluorescent pigments or magnetic pigments.

Sequesterant agents are e.g. diethylenetriaminepentaacetic acid (penta sodium salt).

Examples of rheology modifiers are xanthan gum, methylcellulose, hydroxypropyl methyl-cellulose, or acrylic polymers such as sold under the tradenames Ciba® Rheovis® 112, Ciba® Rheovis® 132 and Ciba® Rheovis® 152.

An example of a wetting agent is Ciba® Irgaclear® D, a sorbitol based clarifying agent, Examples of biocides are Acticide® MBS, which includes a mixture of chloromethyl isothiazolinone and methyl isothiazolinone, Biocheck® 410, which includes a combination of 2-dibromo-2,4-dicyanobutane and 1,2-benzisothiazolin-3-one, Biochek®721M, which includes a mixture of 1,2-dibromo-2,4-dicyanobutane and 2-bromo-2-nitro-1,3-propandiol and Metasol®TK 100, which includes 2-(4-thiazolyl)-benzimidazole.

An example of a smoke suppressant is ammonium octamolybdate.

Taggants are substances added to a product to indicate its source of manufacture.

The additives are no compulsory constituent of the fiber products according to the present invention, i.e. some of them may be present, if desired, but may be also missing. If they are employed, they are usually added in the amounts customary in the paper or board making art for the particular additive. Hence, as long as the additive does not have a negative influence on the desired activity of the acid or the retention aid for the acid, an adequate amount of an additive is in the context of the present invention normally the amount customary in the paper or board making art for the particular additive. In case of such negative influence the amount of the additive has to be reduced until the negative influence has gone or has been reduced to an acceptable level. For example, care has to be take that certain additives do not neutralize the whole acid employed.

Those parts of the resulting fiber product, where a marking is intended, are exposed to energy by means of a laser beam. Especially suitable are low energy lasers (0.3-50 mJ/cm$^2$ preferably 0.3-5 mJ/cm$^2$), like $CO_2$ IR lasers (having e.g. wavelength: 10'600 nm, power: 0.5 to 4 W, diameter of laser beam: 0.35 mm, line speed 300 to 1000 mm/s), but, if suitable laser light absorbents, i.e. absorbents tuned to the wave length of the desired laser, are added, other lasers, like YAG-lasers (yttrium-aluminium-garnet-lasers; YAG-lasers doped with neodyme [Nd:YAG-lasers] emit IR [infra-red] radiation of 1064 nm wave length) or diode lasers can be used as well.

Best marking results are obtained when the pH of the fiber stock comprising the acid, retention aid, and, if desired, further additives is about 5.0 to 6.5, preferably about 5.5 to 6.5, e.g. 6.0. A pH at the upper level of this range is often preferred by the user because acidic papers suffer from stability drawbacks.

The invention relates also to a process for preparing the fiber product of the present invention comprising mixing adequate amounts of the acid, retention aid, water, and, if desired, further additives with the fiber stock, e.g. paper stock, during fiber product making, e.g. papermaking, and isolating the fiber product. The adequate amounts of the acid, retention aid, and additives are as specified herein above.

The fiber product of the present invention is manufactured starting e.g. from a suspension, especially an aqueous suspension, comprising cellulose fibers, water and additives. Said fiber suspension usually comprises from 0.3 to 15%, preferably 0.5 to 1.5% by weight of cellulose fibers. This proportion of cellulose fibers in the suspension must be such that, after removal of the water, the finished fiber product contains at least 20% by weight of cellulose fibers, based on the fiber product without water, acid, retention aid and further additives.

The cellulose fibers may e.g. comprise 30% sulfate long fiber and 70% sulfate short fiber milled to 35° SR.

On a laboratory scale one may e.g. proceed further as follows:

The suspension is stirred for some time, e.g. 1 hour, e.g. at room temperature. Thereafter, if desired, more water may be added, followed by an aqueous solution of the retention aid for the acid, e.g. an aqueous solution containing 5% by weight of Lupasol® P available from BASF, which is a high molecular weight polyethyleneimine. After a time sufficient to ensure that the retention aid is retained with the fibers, an aqueous solution of the acid, e.g. an aqueous solution containing 5% by weight of 1-hydroxyethylene-1,1-diphosphonic acid (HEDPA), are added. If necessary, the pH of the suspension is adjusted to about 5.5 to 6.5, preferably about 6.0. The acid may also be partially pre-neutralized, for example by reaction with a suitable amine, like ethanolamine. After stirring the suspension for a time sufficient to ensure that the acid is retained with the fibers, e.g. by way of reaction with the retention aid, and, if desired, after adding more water, the suspension may e.g. be filtered by suction to form a sheet of the fiber product, e.g. a sheet of paper, which may be dried e.g. at an elevated temperature, e.g. about 90° C.

As evident from Table 1 further below, the paper thus obtained exhibits considerably stronger marks in comparison to control paper not treated with the acid and retention aid when exposed to a laser beam.

The above laboratory scale process may be adapted to industrial scale as is well known to a person skilled in the art (cf. e.g. Handbook of Paper & Board, E. Holik, Wiley-VCH Verlag, Weinheim, 2006).

The following Examples illustrate the invention.

EXAMPLE 1

10 g of fiber raw material are suspended in 400 g of water at room temperature. The fiber material consists of 30% sulfate long fiber and 70% sulfate short fiber milled to 35° SR. This suspension is stirred for 1 hour. After addition of another 400 g of water 14 g of an aqueous solution containing 5% by weight (calculated on the basis of a 100% content of the active substance, i.e. polyethyleneimine) of Lupasol® P available from BASF, which is a high molecular weight (average molecular weight of about 750,000) polyethyleneimine having a solids content of about 48-52% by weight, are added. After 5 minutes 15 g of an aqueous solution containing 5% by weight 1-hydroxyethylene-1,1-diphosphonic acid (HEDPA) are added. The pH of the suspension is 6.0. The suspension is stirred for another 15 minutes, filled up with water to a weight of 1000 g and filtered by suction to form a paper sheet with a specific weight of 80 g/m$^2$. The sheet is dried for 15 min at 90° C. The sheet is then imaged using a $CO_2$ IR laser (wavelength: 10'600 nm, power: 0.5 to 4 W, diameter of laser beam: 0.35 mm, line speed 300 to 1000 mm/s) to yield a high contrast brown marking which is a trace to distinctly stronger compared to untreated fiber used as a standard (cf. Table 1 further below).

If the pH value is adjusted with less acid, e.g. to a pH range of 7-8 the sheets produced show much weaker markings by laser imaging.

EXAMPLES 2 and 3

If 15 g of the 5% aqueous HEDPA solution in Example 1 are replaced by 19 g of a 5% aqueous solution of phytic acid, or by 11.6 g of a 5% aqueous solution of polyphosphoric acid (PPA; 5% stock solution prepared from 5 g of 83% PPA based on phosphorus oxide ($P_2O_5$) content diluted to 100 g by water), sheets are obtained, which mark considerably stronger using the above $CO_2$ IR laser.

EXAMPLES 4-6

These examples are prepared accordingly using the parameters as depicted in Table 1 and giving marking results with a $CO_2$ laser as shown in the same table.

EXAMPLE 7

With Pre-Neutralization of the Acid 10 g of fibre raw material are suspended in 400 g of water at room temperature. The fiber material consists of 30% sulfate long fiber and 70% sulfate short fiber milled to 35° SR. This suspension is stirred for 1 hour. After addition of another 400 g of water 5.6 g of an aqueous solution containing 5% by weight (calculated on the basis of 100% active substance) of Lupasol P®, BASF, is added. After 5 minutes 13 g of an aqueous solution containing 5% of 1-hydroxyethylene-1,1-diphosphonic acid (HEDPA), partially pre-neutralized with 0.19 g of ethanolamine to a pH of 2.4, are added. The pH of the final suspension is 6.0. The suspension is stirred for another 15 minutes, filled up with water to a weight of 1000 g and filtered by suction to form a paper sheet with a specific weight of 80 g/m$^2$. The sheet is dried for 15 minutes at 90° C. The sheet is then imaged using a $CO_2$ IR laser (wavelength: 10'600 nm, power: 0.5 to 4 W, diameter of laser beam: 0.35 mm, line speed 300 to 1000 mm/s) to yield a high contrast brown marking.

EXAMPLES 8-14

These examples are prepared according to Example 7 using the parameters as depicted in Table 1 and giving marking results with a $CO_2$ laser as shown in the same table.

TABLE 1

Experimental data, marking results
In Examples 1-14 the pH of the stock suspension before sheet formation is 6.0.
The amount of polyphosphoric acid is calculated as $P_2O_5$.
Amounts of additives per 1000 g of fiber

| Example | Amount of Lupasol P (100%) [g] | Amount [g] (100%) and kind of acid derivative | P detected on paper [%] | Degree of exhaustion for phosphoric acid [%] | Amount [g] and kind of amine (100%) used for neutralizing about half of the acid | pH of acid solution after partial neutralization | Marking result on treated cellulose fibre relative to standard (1-4 W laser) |
|---|---|---|---|---|---|---|---|
| Standard | 0 | 0 | | | | | standard |
| 1 | 70 | 75, HEDPA | 1.1 | ~55 | 0 | — | trace to distinctively stronger |

TABLE 1-continued

Experimental data, marking results
In Examples 1-14 the pH of the stock suspension before sheet formation is 6.0.
The amount of polyphosphoric acid is calculated as $P_2O_5$.
Amounts of additives per 1000 g of fiber

| Example | Amount of Lupasol P (100%) [g] | Amount [g] (100%) and kind of acid derivative | P detected on paper [%] | Degree of exhaustion for phosphoric acid [%] | Amount [g] and kind of amine (100%) used for neutralizing about half of the acid | pH of acid solution after partial neutralization | Marking result on treated cellulose fibre relative to standard (1-4 W laser) |
|---|---|---|---|---|---|---|---|
| 2 | 70 | 95, phytic acid | 1.4 | ~60 | 0 | — | considerably stronger |
| 3 | 70 | 58, poly-phosphoric acid | 1.7 | ~80 | 0 | — | considerably stronger |
| 4 | 28 | 30, HEDPA | 0.5 | ~55 | 0 | — | trace stronger |
| 5 | 28 | 38, phytic acid | 0.6 | ~60 | 0 | — | distinctively stronger |
| 6 | 28 | 23.2, poly-phosphoric acid | 0.7 | ~80 | 0 | — | distinctively stronger |
| 7 | 28 | 65, HEDPA | 0.8 | ~45 | 19 ethanol-amine | 2.4 | trace stronger |
| 8 | 28 | 82, phytic acid | 1.1 | ~55 | 21.5 ethanol-amine | 2.1 | considerably stronger |
| 9 | 28 | 79, phytic acid | 1.0 | ~50 | 6.0 ammonia | 2.1 | considerably stronger |
| 10 | 28 | 80, phytic acid | 1.1 | ~55 | 18.3 oxybis-ethylamine | 2.1 | considerably stronger |
| 11 | 28 | 35, poly-phosphoric acid | 1.1 | ~80 | 11 ethanol-amine | 1.4 | considerably stronger |
| 12 | 28 | 35, poly-phosphoric acid | 1.1 | ~80 | 3.1 ammonia | 1.4 | considerably stronger |
| 13 | 28 | 36, poly-phosphoric acid | 1.1 | ~80 | 9.4 oxybis-ethylamine | 1.4 | considerably stronger |
| 14 | 15 | 25, poly-phosphoric acid | 0.8 | ~80 | 19 ethanol-amine | 3.2 | distinctively to considerably stronger |

The invention claimed is:

1. A process for preparing a marked fiber product comprising at least 20% by weight of cellulose fibers, based on the weight of the anhydrous fiber product, comprising the steps of i) incorporating into the body of the fiber product a) 1% to 10% by weight, based on 100% by weight of anhydrous fiber substrate, of at least one acid, that may be partially pre-neutralized with a base, wherein the acid is selected from at least one of polyphosphoric acid, phytic acid, diethylenetriamine penta(methylenephosphonic acid), hexamethylenediamine tetra(methylene-phosphonic acid), nitrilotris (methylene phosphonic acid), 1-hydroxyethyl(id)ene-1,1-diphosphonic acid, amino-tri(methylene) phosphonic acid, ethylene diamine tetra-(methylene) phosphonic acid, 2-phosphono-1,2,4-butanetricarboxylic acid, 2-(4-aminophenyl)-6-methylbenzothiazole-7-sulfonic acid, and abietic acid, wherein the proton in the OH group of the at least one acid may be at least partially replaced by ammonium or a protonated amine, and b) 0.3% to 7% by weight, based on 100% by weight of anhydrous fiber substrate, of a cationic retention aid, and ii) exposing those parts of the resulting fiber product, where a marking is intended, to energy by means of a laser beam, wherein the fiber product exhibits stronger marks in comparison with a fiber product not treated with said acid and retention aid when exposed to a laser beam.

2. The process of claim 1, wherein the fiber product is paper or board.

3. The process of claim 1, wherein the acid is selected from at least one of polyphosphoric acid, phytic acid, 2-(4-aminophenyl)-6-methylbenzothiazole-7-sulfonic acid, and abietic acid.

4. The process of claim 1, wherein the retention aid is selected from at least one of polymers having protonable functional groups or cationic groups and having a natural affinity for cellulosic fibers.

5. The process of claim 4, wherein said polymers are selected from at least one of polyamines and polyimines.

6. The process of claim 4, wherein said polymers are selected from at least one of polyethyleneimines, polyvinylamines, polyallylamines, epichlorohydrin based polyamines, dicyanodiamide based polyamines, cationic polyacrylamide based copolymers and terpolymers, cationic starches, and natural polymers with cationic character.

7. The process of claim 4, wherein said polymers are selected from at least one of polyvinylamines, polyallylamines, epichlorohydrin based polyamines, dicyanodiamide based polyamines, cationic polyacrylamide based copolymers and terpolymers, cationic starches, and natural polymers with cationic character.

8. The process of claim 1, wherein the fiber product comprises in its body 1% to 2.0% by weight, based on 100% by weight of anhydrous fiber substrate, of a cationic retention aid.

9. A laser-markable fiber product comprising at least 20% by weight of cellulose fibers, based on the weight of the anhydrous fiber product, comprising in its body i) 1% to 10% by weight, based on 100% by weight of anhydrous fiber substrate, of at least one acid that may be partially pre-neutralized with a base, wherein the acid is selected from at least one of polyphosphoric acid, phytic acid, diethylenetriamine penta(methylenephosphonic acid), hexamethylenediamine tetra (methylene-phosphonic acid), nitrilotris(methylene phosphonic acid), 1-hydroxyethyl(id)ene-1,1-diphosphonic acid, amino-tri(methylene) phosphonic acid, ethylene diamine tetra-(methylene) phosphonic acid, 2-phosphono-1,2,4-butanetricarboxylic acid, 2-(4-aminophenyl)-6-methylbenzothiazole-7-sulfonic acid, and abietic acid, and ii) 0.3% to 7% by weight based on 100% anhydrous fiber substrate of a cationic retention aid, wherein the fiber product exhibits stronger marks in comparison with a fiber product not treated with said acid and retention aid when exposed to a laser beam.

10. A process of preparing the fiber product of claim 9, comprising:

mixing adequate amounts of the acid, retention aid, and water with the fiber stock during fiber product making, and isolating the fiber product, wherein the fiber product exhibits stronger marks in comparison with a fiber product not treated with said acid and retention aid when exposed to a laser beam.

11. A laser-marked fiber product comprising at least 20% by weight of cellulose fibers, based on the weight of the anhydrous fiber product, comprising in its body i) 1% to 10% by weight, based on 100% by weight of anhydrous fiber substrate, of at least one acid that may be partially pre-neutralized with a base, wherein the acid is selected from at least one of polyphosphoric acid, phytic acid, diethylenetriamine penta(methylenephosphonic acid), hexamethylenediamine tetra(methylene-phosphonic acid), nitrilotris(methylene phosphonic acid), 1-hydroxyethyl(id)ene-1,1-diphosphonic acid, amino-tri(methylene) phosphonic acid, ethylene diamine tetra-(methylene) phosphonic acid, 2-phosphono-1,2,4-butanetricarboxylic acid, 2-(4-aminophenyl)-6-methylbenzothiazole-7-sulfonic acid, and abietic acid, and ii) 0.3% to 7% by weight based on 100% anhydrous fiber substrate of a cationic retention aid, wherein the fiber product exhibits stronger marks in comparison with a fiber product not treated with said acid and retention aid when exposed to a laser beam.

* * * * *